US008632133B2

(12) United States Patent
Chugh

(10) Patent No.: US 8,632,133 B2
(45) Date of Patent: Jan. 21, 2014

(54) WATER SPRAYS FOR DUST CONTROL ON MINING MACHINES

(75) Inventor: Yoginder P. Chugh, Murphysboro, IL (US)

(73) Assignee: Board of Trustees of Southern Illinois University

( * ) Notice: Subject to any disclaimer, the term of this patent is extended or adjusted under 35 U.S.C. 154(b) by 156 days.

(21) Appl. No.: 13/187,676

(22) Filed: Jul. 21, 2011

(65) Prior Publication Data

US 2012/0018544 A1 Jan. 26, 2012

Related U.S. Application Data

(60) Provisional application No. 61/366,356, filed on Jul. 21, 2010.

(51) Int. Cl.
*E21C 35/22* (2006.01)

(52) U.S. Cl.
USPC ..... 299/12

(58) Field of Classification Search
USPC ..... 299/12, 81.1, 81.2, 81.3
See application file for complete search history.

(56) References Cited

U.S. PATENT DOCUMENTS

| | | | | | |
|---|---|---|---|---|---|
| 4,157,204 | A | * | 6/1979 | Kissell et al. | 299/64 |
| 4,186,971 | A | * | 2/1980 | Gebetsroither et al. | 299/64 |
| 4,487,615 | A | * | 12/1984 | Taylor et al. | 95/154 |
| 4,632,462 | A | * | 12/1986 | Poling | 299/12 |

FOREIGN PATENT DOCUMENTS

| | | | | |
|---|---|---|---|---|
| DE | 102010022114 | A1 | * | 11/2011 |
| SU | 1265371 | A | * | 10/1986 |
| SU | 1567767 | A | * | 5/1990 |
| WO | WO 9711255 | A1 | * | 3/1997 |

* cited by examiner

*Primary Examiner* — Sunil Singh
(74) *Attorney, Agent, or Firm* — Husch Blackwell, LLP; Mark Stallion

(57) ABSTRACT

This invention refers to innovative water sprays applications to significantly improve coal and quartz dust control around a continuous miner. Significant dust control is achieved through utilizing different types of sprays at locations on the top and sides of the miner chassis to create water curtains or shrouds of water around zones of high dust concentration and zones of high concentration dust transport. This is called "multiple lines of defense" spray system (MLD.) This invention also provides a method of reducing dust around a continuous miner by configuring a spray system, located at the top or sides of the cutter boom, thereby improving control of respirable dust.

16 Claims, 11 Drawing Sheets a.

b.

Prior Art

Prior Art a.

WATER SPRAYS FOR DUST CONTROL ON MINING MACHINES

CROSS-REFERENCE TO RELATED APPLICATIONS

This application claims priority to an earlier filed co-pending Provisional Patent application No. 61/366,356 filed Jul. 21, 2010 entitled Innovative Water Sprays Applications for Dust Control on Mining Machines.

FIELD OF THE INVENTION

This invention relates to mining. More specifically, it relates to dust control around a continuous miner or similar mining machine through the use of water spray applications.

BACKGROUND OF THE INVENTION

Increased productivity and high out-of-coal seam dilution (25% to 30%) in the US and around the globe continue to generate dust control problems in mining areas. After a significant decrease in the number of incidents of coal worker's pneumoconiosis (CWP) over the last several decades, the number of reported cases in this decade is increasing. The primary cause of CWP is inhalation of respirable dust in a confined workplace; specifically, the inhalation of coal and quartz dust in a mine. The National Institute for Occupational Safety and Health recognizes this disease as being severely disabling, potentially lethal, and entirely preventable through respirable (less than 10 micron) dust control. The typical protocol for prevention of this disease has been monitoring mine workers for symptoms of this disease and, once a CWP diagnosis has been made, moving the miner to a low-dust exposure job. Prevention of this disease through a significant reduction in mine workers' exposure to respirable dust is a high priority. Additionally, several mines are now facing reduced dust standards due to high respirable quartz content in the dust. In underground US coal mines, miner operator (MO), haulage unit operator (HO), and roof bolting (RB) unit operator are typically overexposed to respirable dust.

The conventional approach to dust control in a mine has been the use of water sprays located on the mining machines to wet the coal. Approximately located and intuitively designed water sprays on the cutter drum and around the continuous miner chassis have been extensively used to control dust for the miner operator (MO), batch haulage unit operator (HO), haulage roadways, and material transfer points. A continuous miner or CM is extensively used for coal production in partial extraction mining areas. Typical spray systems, provided by manufacturers, have 15-45 sprays located across the top and the sides of the cutter boom (FIGS. 1A and 1B). In addition, under-the-boom and loading pan sprays on some miners provide water sprays to contain and wet the dust in the face area. However, there is no consensus in the art area on the type and location of sprays, volume of water and water pressure to be used in sprays. Although general guidelines have been developed by researchers based on laboratory and field studies, there is no systematic method of design or apparatus for using a spray system to meet the specific conditions to be encountered.

Several studies over the last several decades have attempted to locate the source of and have attempted a solution to the dust problems in mining environments. The conventional wisdom is that presented by Chang and Zukovich (Cheng L and Zukovich P. P. 1973. Respirable dust adhering to run-of-face bituminous coals. Pittsburgh, Pa.: U.S. Department of the Interior, Bureau of Mines, RI 7765. NTIS No. PB 221-883.) Their position was that a large amount of dust created does not become airborne and stays attached to the broken material. Therefore, spraying more water on the broken material tends to reduce dust. Adding water directly at the cutting picks that gets mixed with fragmented coal is more important than creating a shroud of water around the miner or shearer. Based on this observation, the conventional practice of mixing the water uniformly with broken coal was developed. However, this approach alone has not been effective in mine dust control.

More recently it has been observed that water can be used to control dust through the wetting of broken material and capture of airborne dust. (Kissel, F., "Handbook for Dust Control in Mining", NIOSH, Information Circulation (IC 9465), 2003, pp. 131.) Although the methods of wetting broken material have been more uniform throughout the industry, a haphazard approach has been taken to the capture of airborne dust through the use of water sprays. This is most likely due to the problem and sometimes conflicting proposed solutions. It is suggested that a large number of smaller-volume sprays is better for dust control than smaller number of larger-volume sprays. Jayaraman and others concluded that many spray systems can create turbulent airflow in the face area that can result in rollback of dust. (Jayaraman, N, Fred N. Kissel, and W. E. Schroder (1984), "Modify Spray Heads to Reduce Dust Rollback on Miners," Coal Age, June 1984)

However, certain research has proven valuable in the design of water spray systems. Courtney and Cheng concluded that typical water sprays operating at 100 psi do not capture more than 30% airborne dust in an open environment. (Courtney W. G. & Cheng L. 1977. Control of respirable dust by improved water sprays. In: Respirable Dust Control—Proceedings of Technology Transfer Seminars, Pittsburgh, Pa., and St. Louis, Mo., IC 8753, pp. 92-108. NTIS No. PB 272 910.) Furthermore, inappropriately designed sprays can displace dust clouds rather than wet or capture airborne dust. Reducing the water droplet size through the use of atomizing or fogging sprays may temporarily improve the airborne dust capture efficiency. However, small droplets tend to collapse/evaporate easily and release the captured dust. (McCoy J., Melcher J., Valentine J., Monaghan D., Muldoon T. & Kelly J. 1983. Evaluation of charged water sprays for dust control. Waltham, Mass.: Foster-Miller, Inc. U.S. Bureau of Mines contract no. H0212012. NTIS No. PB83-210476.) Atomizing nozzles are most efficient in airborne dust capture followed by hollow cone, full cone, and flat sprays. Hollow cone sprays are less likely to clog due to larger orifice area.

Nozzles operating at higher pressures are likely more efficient in the use of water while providing similar airborne dust capture efficiency as those operating at lower pressures. However, high-pressure sprays tend to disperse more dust. Therefore, their use is more appropriate in a relatively confined environment.

Courtney and others reported that the primary release point for dust from a CM is from under the boom when the cutter head shears down. (Courtney, W. G, N. I. Jayaraman, and P. Behum (1978), "Effect of Water Sprays for Respirable Dust Suppression with Research Continuous Mining Machine", BuMines RI-8283, 17 pp) Thus, under-boom sprays should be considered. However, location and maintenance of under-boom sprays presents significant problems. Jankowski reported results for an alternate under-boom spray system with about 25% improved dust reduction (Jankowski, Robert A, N. I. Jayaraman, and C. A. Babbitt (1987), "Water Spray System for Reducing Quartz Dust Exposure of the continuous Miner Operator," Proceedings of the 3rd U.S. Mine Ventilation Symposium, Pennsylvania State University, PP 605-611.)

In spite of considerable excellent research by the U.S. Bureau of mines (USBM) and the National Institute of Occupational Safety and Health (NIOSH) over the last 40 years, there are significant limitations to the current practice. These include use of high water pressure on the chassis (100 psi or more); similar water pressure on the chassis and under-boom sprays leading to escape of airborne dust from the sides; only one point of dust control on the top of the chassis; no control on roll-back dust travel; use of only one type of sprays such as hollow-cone for all sprays; poor orientation of sprays, etc. There is a need to revisit the design concepts of sprays on continuous miners to control respirable dust (including quartz dust) in and around the mining face area.

In the industry there is a need for improving spray efficiency. A more reasoned and systematic design is needed that more effectively reduces the respirable dust around mining machinery.

BRIEF DESCRIPTION OF THE DRAWINGS

FIG. 1B—A side view of the continuous miner of FIG. 1A.

FIG. 2B—(a) An operator side view of the continuous miner of FIG. 2A; (b) A scrubber side view of the continuous miner of FIG. 2A.

FIG. 2C—A detailed view of the cutter boom of the continuous miner of FIG. 2B.

FIG. 3B—(a), (b) A side view of one embodiment of the dust containment spray system around the cutter boom of a continuous miner featuring a spray configuration including SLD sprays.

FIG. 4B—(a) A sectional view of the center head sprays block; (b) Another sectional view of the center head sprays block.

FIG. 4C—A top view of the center and side head sprays blocks.

SUMMARY OF INVENTION

Figure 1A:
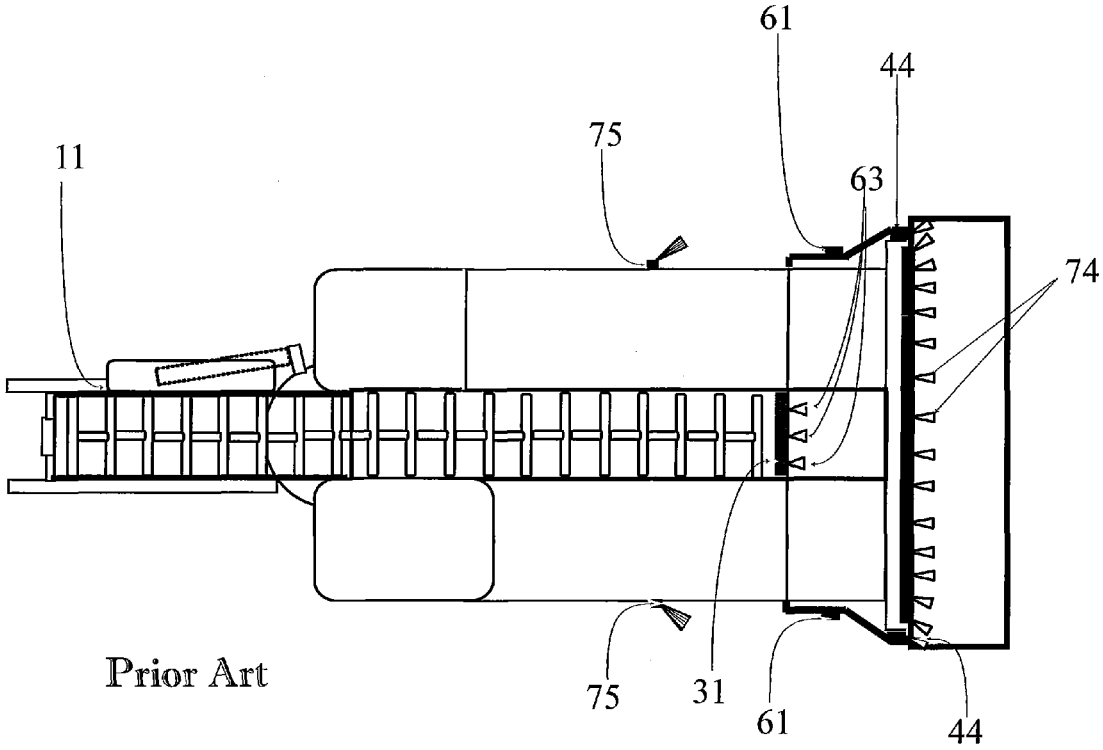
FIG. 1A—A top view of a continuous miner featuring an exemplary conventional spray system.

In order to revisit the sources of mine dust and to analyze how the conventional technology is failing to provide adequate control of mining dust, it is important to analyze the sources and locations of respirable dust around continuous miners in multiple environments. It is also important to identify several areas in the mine where dust control could be introduced or improved: along the roof level of the mine, at the location of the conventional spray blocks, at the sides and under the miner, and at transfer points near the last open crosscut return.

A high concentration of respirable dust occurs near and along the roof level. Location of boom sprays for the cutter drum, loading pan sprays, under-boom spray pressure, type of sprays used and high water spray pressure (~100 psi) used can displace dust-laden air along the roof level, towards the sides, and back of the miner and results in roll-back on the miner chassis toward the miner operator and batch haulage unit operator. This dust-laden air is moving at a relatively high velocity based on water pressure used and seam height and, due to its fine size dust particles, is not captured by suction inlets of a scrubber.

Spatial location of sprays on the spray blocks and type of sprays used can typically result in significant interaction among sprays. These interactions (caused by different sprays colliding with each other) can result in droplet size increase after interaction. Conventional cutter drum head sprays are directed at the rotating drum and cutting bits at different angles in the horizontal plane so that air moves across the face and is directed in the return entry. In several cases, these sprays intercept each other upon discharge from the orifice resulting in not only larger droplets that negatively impact dust control, but also in wasted energy. Since the ability to capture dust requires that the water droplet size be near the size of the dust particle, this interaction significantly reduces the potential to wet the finer fractions of dust. Furthermore, most of the spray energy is dissipated in interactions rather than in wetting the dust.

The side sprays on the miner operator side tend to contain the dust in the face area. These sprays attempt to create a seal between the sides of the excavation and the continuous miner. However, the seals are generally incomplete due to the large distance between the sprays and the excavation sides and interactions between these side sprays and the boom and under-boom sprays. Again, dust is pushed towards the roof level, or to the sides, or underneath the miner.

Most of the dust load in the scrubber is from the scrubber suction inlet at the bottom over the coal conveyor. Even if the scrubber does an excellent job of wetting the dust, the dust generated during the material discharge from the conveyor into the haulage unit significantly increases dust concentration in the last open crosscut return (LOXC). In an attempt to control dust at material discharge points, throat sprays may be located above the conveyor carrying the cut material to be discharged in the haulage unit. Since conveyor speed is very high, water discharged from throat sprays only wets the surface of coal and it is not uniformly distributed in the entire mass of the material. This results in significant dust creation when the material is dumped into the haulage unit.

Movements of batch haulage units around the face area further complicate dust concentration and turbulence in the face area and intake air flow to the face area.

In the industry there is a need for improving spray efficiency. Various embodiments of the present invention are designed for improving the dust suppression using hydraulic sprays on the continuous miner: utilizing appropriate spray pressures spatially to minimize pushing the dust toward the roof, sides, and underneath the miner; wet and surround the airborne dust to allow the scrubber to capture it; and further wet the airborne dust escaping the scrubber inlets area before it enters the area behind the miner and the LOXC.

Various embodiments of the present invention utilize spatial distribution, spray pressure and type of sprays to address the problems identified in the prior art. Principles on spray configurations include: solid-cone sprays are ideal for wetting the broken coal but not good for wetting the air-borne fine particle dust; hollow-cone sprays are more efficient for wetting the airborne dust than flat sprays; flat sprays are more efficient for creating a hydraulic curtain than wetting the dust; narrow-angle sprays at a particular pressure reach farther than wide-angle sprays; narrow angle sprays cover a small area and therefore more number of sprays is needed to cover an area; inappropriate spatial location of sprays can increase interaction among sprays that may result in increasing spray droplet size, wasted spray pressure energy, and hollow-cone behaving more like a solid cone spray; and using high pressure water sprays can decrease likelihood of contact between dust particles and water droplets and decrease residence time for wetting the dust and low water pressure results in larger droplet sizes that are not effective for wetting fine particle sizes.

REFERENCE NUMERALS IN DRAWINGS

11 Material Transfer Conveyor
12 Material Load Pan
15 Cutter Drum Hinge Point
16 Cutter Boom
21 Scrubber
22 Scrubber Suction Inlet
31 Scrubber Water Discharge Bar
32 Water Port Inlet
33 Water Supply Inlet
34 Sprays Nozzle Recess
41 SLD Sprays
42 Head Sprays Block
44 Outer Bit-ring Sprays
51 TLD Top Sprays Block
52 TLD Operator Side Sprays Block
53 TLD Scrubber Side Spray Block
61 Conventional Side Cutter-boom sprays
63 Conveyor Throat Sprays
68 Side Cutter-boom sprays
72 Center Head Sprays Block
73 Under Cutter-boom sprays
74 Existing Cutter Drum Head Sprays
75 Side Chassis Sprays
77 Conventional Throat Sprays
82 Outer Bit-ring Sprays
84 Throat Sprays
86 Cutter Drum Head Sprays
88 Material Load Pan
89 Scrubber Water Discharge Bar
90 Cutter Boom
92 Cutter Drum Hinge Point
94 Scrubber Suction Inlet
96 Material Transfer Conveyor

DESCRIPTION OF THE PREFERRED EMBODIMENTS

The primary means of dust control should be preventing the dust generated at the cutting faces from becoming airborne. Hollow-cone or flat sprays directed into the bits and the cutting face should help achieve this objective and cool the cutting bits.

Once the dust is airborne, the flooded-bed scrubber is an efficient mechanism at the face to capture the dust and wet it within the scrubber. Hence, the goal should be to maximize the amount of airborne dust that gets directed into the scrubber. To accomplish this, appropriately angled flat sprays or wide-angle hollow-cone sprays on the boom behind the first set of sprays create a shroud containing the generated dust near the face area in a restricted volume.

Similarly, flat or hollow-cone sprays underneath the cutting boom may envelope the gap between the pan and the boom and contain the airborne dust such that the central suction port of the scrubber is able to draw it inside the scrubber. Some miners have under-boom sprays that are directed away from the face toward the conveyor. However, such sprays reduce the residence time or contact time between the dust and water rather than increase it. However, spraying water toward the face area into the loading pan where it can be mixed with the entire volume of cut coal would help reduce generation during material discharge and during transport to dump point.

Under-boom sprays should be operated at a slightly lower pressure (10-20 psi lower) than the chassis sprays on the top of the cutter drum. This will allow the dust laden air to be pushed into the conveyor throat and bottom scrubber suction inlet rather than be pushed toward the roof, sides, or bottom of the miner.

Once the dust is airborne, its capture using hydraulic sprays requires sprays producing droplet sizes in the range of the respirable dust particle sizes or slightly higher. Hence, really fine, misting or atomizing sprays need to be used subject to the constraints of available water pressures and more importantly the constraints involving very small spray orifice sizes which are likely to get plugged in a typical mine environment. These sprays will be placed at the back corner of the loading pan on both sides and directed inside the pan. These sprays are introduced to allow capture of some dust (respirable and coarser than respirable) even before it actually enters the scrubber.

Despite the created shroud of sprays, some of the dust will still escape due to gaps in the shroud where the sprays do not overlap and due to the fact that at times, the cut coal traveling to the conveyor may partially obstruct the central scrubber suction port. Hence, there is a need to employ an improved line of defenses on the side of the continuous miner. This line of defense is implemented in the form of sprays on the left side of the miner located behind the left side suction ports of the scrubber. These sprays should be wide-angle, hollow-cone sprays that essentially create a seal with water curtain from the continuous miner to the left rib and to the roof top to contain the dust such that it gets an opportunity to enter the side suction port. These sprays can be located only on the left side of the miner as the prevailing air flow pattern in the face carries the escaping dust from the right side over the top of the miner and through the area between the left side of the miner and the rib.

As discussed above, dust-laden air along the roof level is moving at a relatively high velocity based on water pressure used, seam height, and rotational speed of the cutting drum. This air is not captured by suction inlets of scrubbers. To capture the dust escaping over the top of the miner, a set of misting sprays may be installed on the top of the miner directed towards the roof and angled towards the face such that the escaping dust contacts the mist and is captured. Furthermore, such sprays contain the dust in the face area and allow time for it to be sucked by the side suction inlets. These Second Line of Defense sprays (SLD sprays) are located on the top, the side, and on the top and sides of the CM chassis and spray water toward the roof and are angled toward the face. An additional set of sprays referred to herein as a Third Line of Defense (TLD) sprays generally located proximate to a set of scrubber suction inlets. Collectively or interchangeably, the SLD sprays and TLD sprays are referred to as a first set of water sprays and a second set of water sprays depending on their position and function. Due to the low inertia of the mist droplets, the mist migrates away from the face concurrently with the air and the respirable dust increasing the residence time for the dust and mist droplets to come in contact and attach resulting in the dust-droplet aggregates to drop out and fall to the ground. The SLD sprays can be small-volume misting sprays and operate at an appropriate pressure so that the resulting water curtain creates a seal against the roof. Appropriate sprays are selected that utilize orifice diameters similar to those of the conventionally used miner sprays, but which produce a very fine mist of water. Spraying Systems Company, Inc. in Chicago, Ill. produces sprays; however, this is not limiting and other fine-misting types of sprays can be substituted.

Figure 2A:
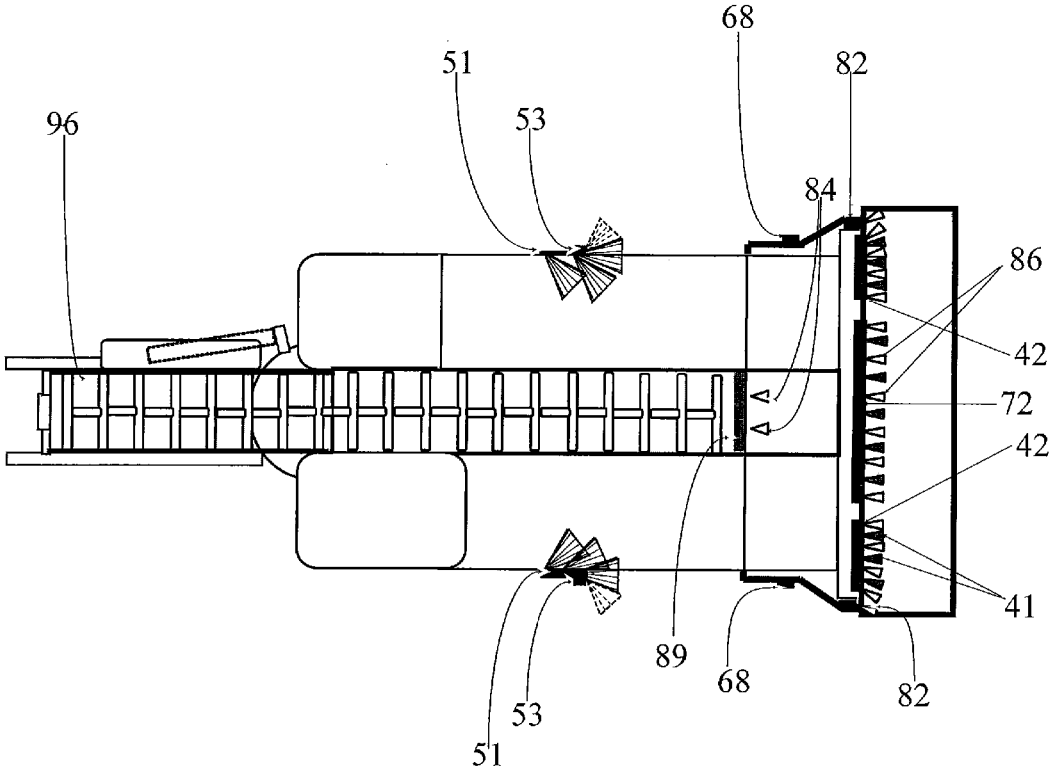
FIG. 2A—A top view of a continuous miner featuring an embodiment of a spray configuration, with Second Line of Defense (SLD) sprays, and Third Line of Defense (TLD) sprays.
Figure 4A:
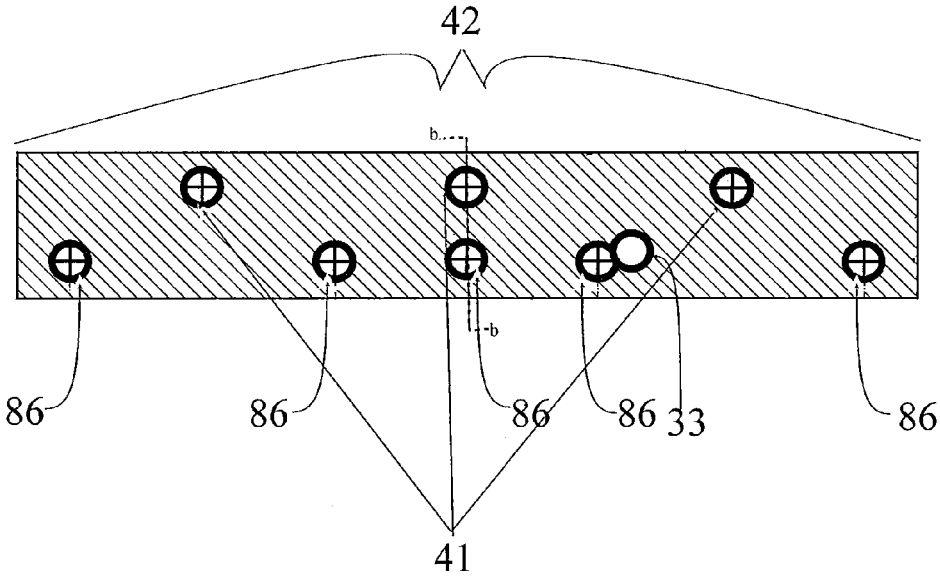
FIG. 4A—(a) A sectional view of the side head sprays block; (b) Another sectional view of the side head sprays block.
Figure 4A:
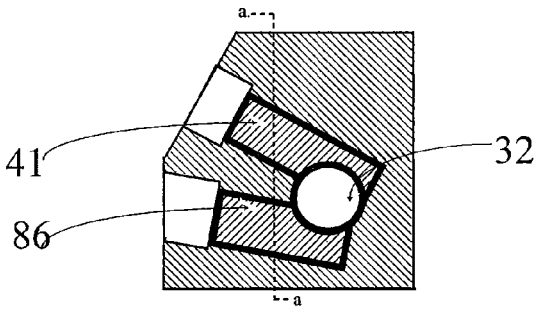
Figure 4B:
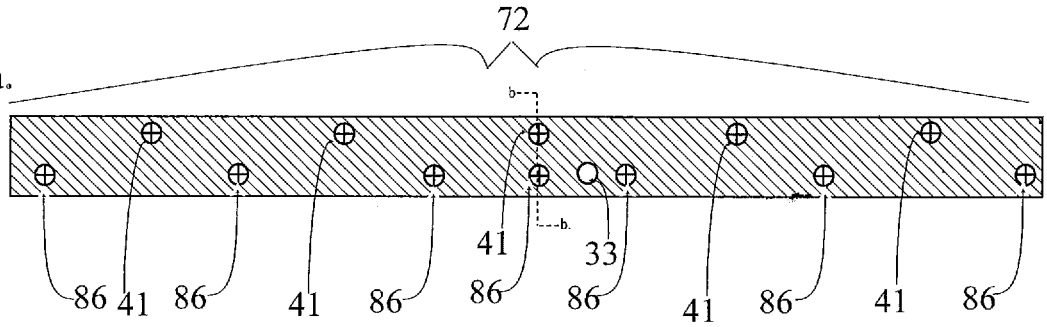
Figure 4B:
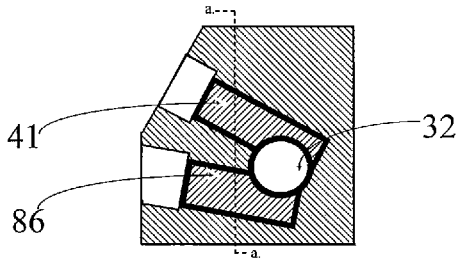
Figure 4C:
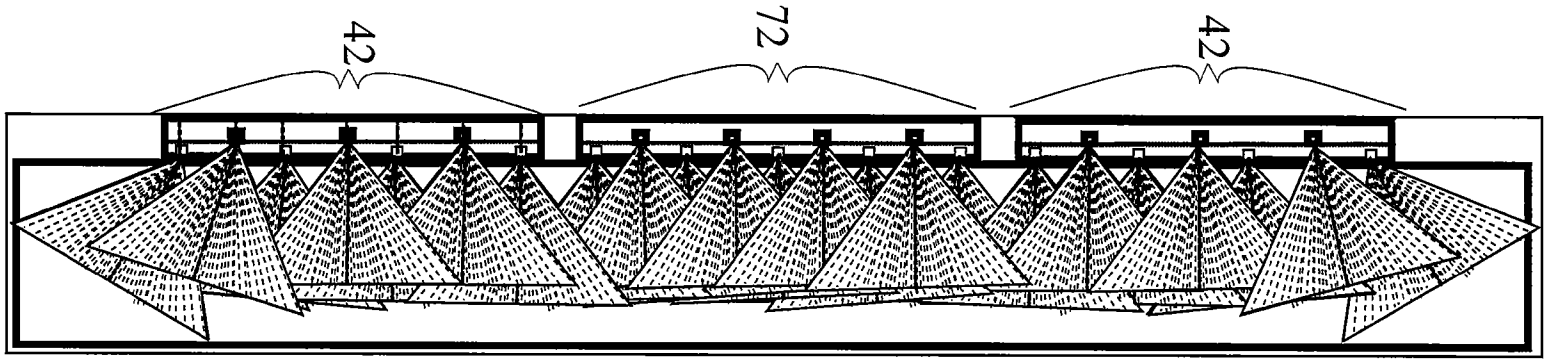

The various embodiments of the present invention are further described in reference to the figures. FIG. 2A shows a top view of one embodiment of the present invention on a CM with a new spray configuration and the TLD and SLD sprays blocks. Around the cutter boom area 90, three sets of sprays serve to contain dust in the face area: the top of chassis sprays, including the center head spray block 72 and two side head sprays blocks 42; the outer bit-ring sprays 82; and the side cutter-boom sprays 68. In the center head spray block 72 and the side head spray blocks 42, the lower sprays include cutter drum head sprays 86 directed at the cutting bits of the CM drum. The SLD sprays 41 are located above the cutter drum head sprays 86 and are angled in the range of 10°-45° higher than traditional head sprays in the vertical plane to create a hydraulic seal behind the lower sprays and the immediate roof; in a preferred embodiments, the SLD sprays 41 are angled approximately 20° above traditional head sprays. The SLD sprays 41 are angled toward the roof of the mine excavation. These sprays perform several functions: the dust generated during cutting of material is contained near the face area and has a chance to be wetted and sucked in by the wet scrubber suction inlets 22; some of the generated dust not wetted by the head sprays gets sucked in the space between the SLD sprays 41 and the cutter drum head sprays 86 and has a chance to get wetted; the dust generated during the cutting of immediate roof material has a chance to be wetted since these sprays are located right behind the cutting drum; and the dust generated in the cutter drum area does not travel toward the mine operator or haulage unit operator (minimizing dust rollback). A sectional view of the side head sprays block 42 is shown in FIG. 4A. A sectional view of the center head spray block 72 is shown in FIG. 4B. A top view of the head sprays is shown in FIG. 4C.

The second set of sprays that contain the dust emanating from the cutter boom area 90 are the outer bit-ring sprays 82; these sprays are oriented differently than conventional sprays so that there is no interference between adjacent sprays. The outer bit-ring sprays 82, as a whole, create air movement toward the face of the cutter drum to remove volatile gas and dust particles.

The third set of sprays around the cutter boom 90 are configured differently than conventional sprays. These sprays are designed to create a seal around the sides of the material loading pan 88 so that dust cannot escape and is wetted in the material loading pan 88 and sucked-in through the wet scrubber suction inlet 94 located on the top of the material transfer conveyor 96. These sprays are oriented to establish seal along the sides of the mining excavation over as large an area as possible. Furthermore, these sprays are directed slightly inward (between 5°-20°) toward the loading pan to push the dust toward the scrubber suction inlet 94.

Figure 5:
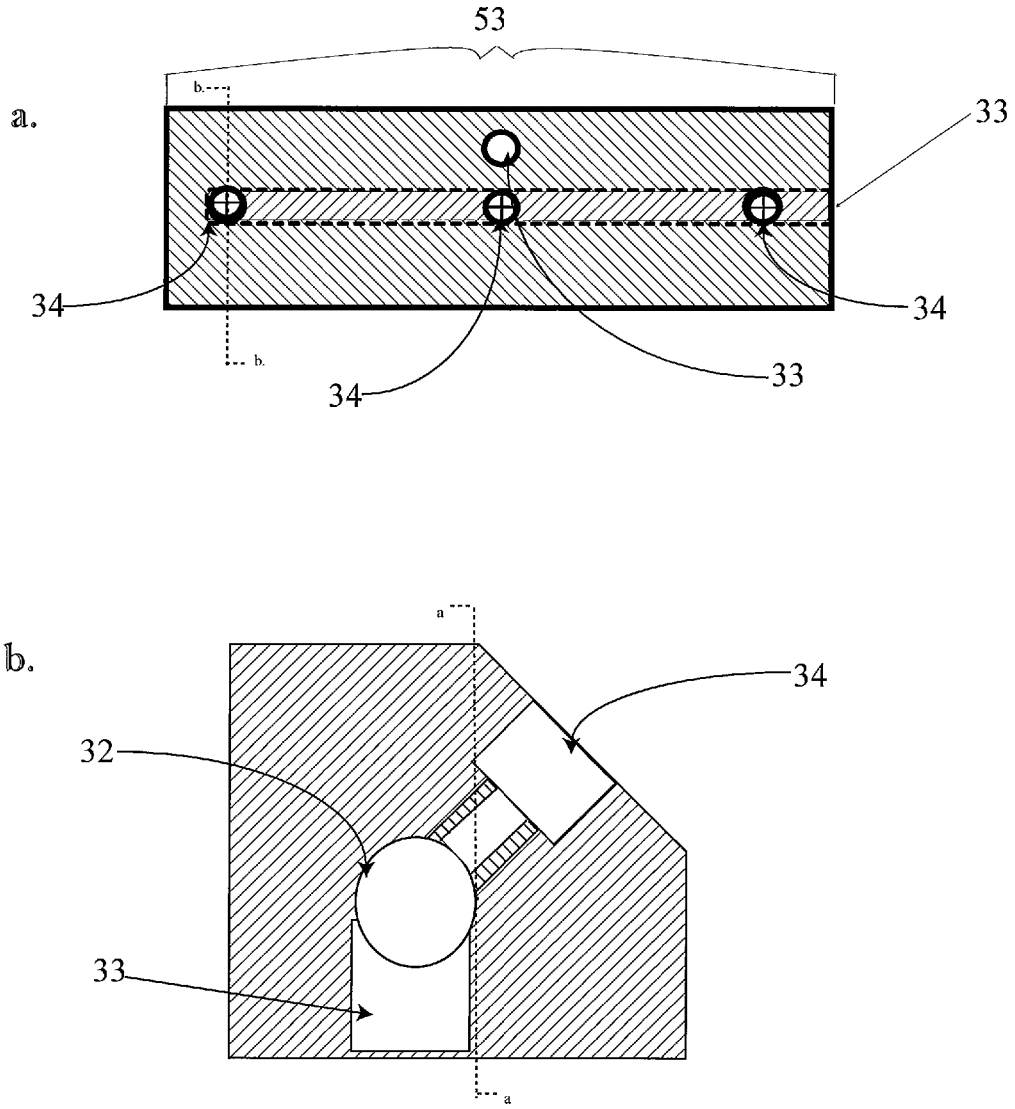
FIG. 5—(a) A sectional view of the TLD scrubber side spray block; (b) Another sectional view of the TLD scrubber side spray block.

On both sides of the CM behind the cutter drum, the TLD sprays prevent any dust not captured by the head sprays, the outer bit-ring sprays 82, or the side cutter-boom sprays 68 from reaching the miner operator or haulage unit operator. The TLD top spray block 51 creates a hydraulic curtain across the excavation between the miner chassis and the roof of the excavation so that escaping dust can be wetted in this area before leaving the face area and without affecting the miner operator, haulage unit operator and other workers working on the downwind side of the miner. The TLD operator side spray block 52 and scrubber side spray block 53 create a seal between the side chassis of the miner and the sides of the excavation. The TLD top spray block 51 is located on the top of the chassis or along the sides of the chassis to ensure that roof falls will not impair their operation. The TLD top spray block 51 consists of 2-3 sprays angled horizontally and vertically in such way that the miner operator can see the mining face cutting area. The operator side spray block 52 and scrubber side spray block 53 also consist of 2-3 sprays oriented vertically and horizontally away from the chassis to create a seal between the chassis and sides of the excavation; sectional view of these spray blocks are shown in greater detail in FIG. 5. The orientation depends upon the height of the excavation, width of the excavation and the size of the cutting drum.

Figure 2B:
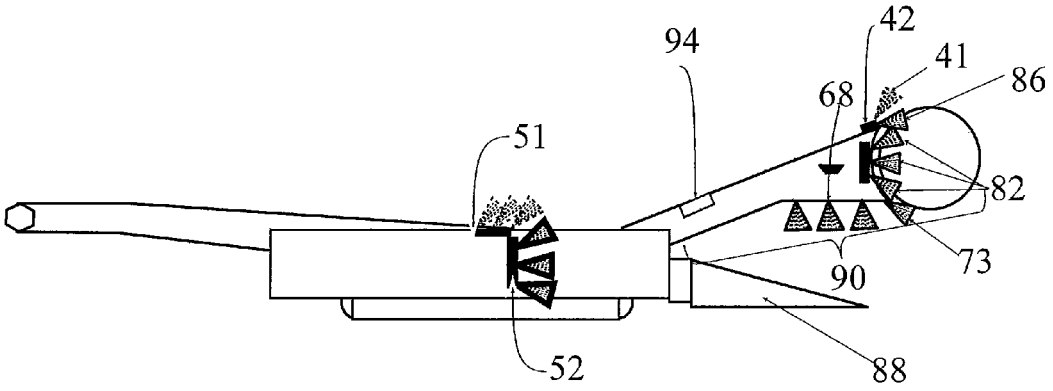
Figure 2B:
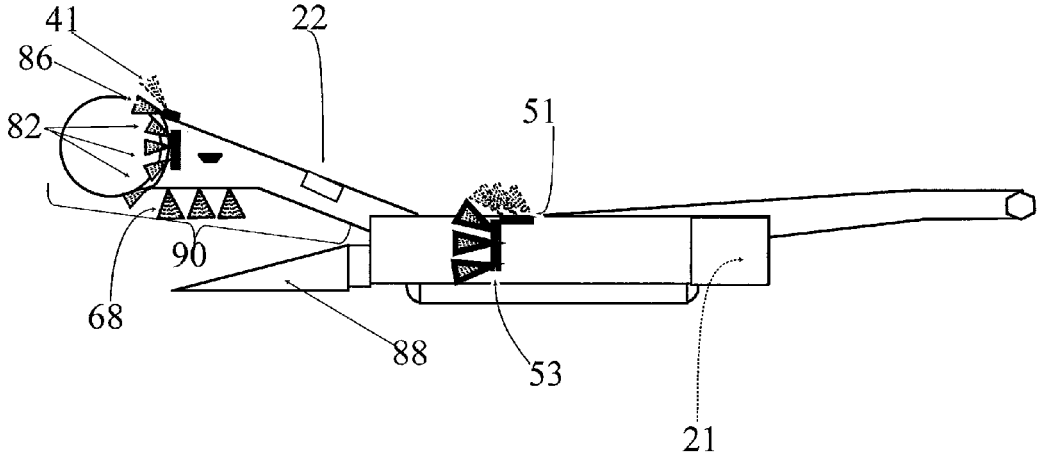

One embodiment of the TLD spray system was installed in a Joy 14 CM, similar to the miner shown in FIG. 2B in order to prove the concept. The CM chassis was 36-inches high, the miner cutting drum was 11.5 ft wide and 38-inches in diameter, and the length of the CM from the front bits on the miner cutting drum to the back end of the continuous miner chassis was 35 ft. The CM was extracting a 60-inch thick coal seam with 9-12 inches of immediate floor strata and about 6-inches of immediate roof strata. Significant amount of airborne dust was produced during the cutting of the immediate roof strata. In an effort to reduce the airborne dust rollback, TLD top spray blocks 51 and TLD operator side 52 and scrubber side 53 spray blocks were installed. Two TLD top spray blocks 51 were installed on the top of the continuous miner chassis: one spray block was installed on the top of the miner chassis on the operator side of the CM approximately 42-inches behind the side scrubber suction inlet 94 and the other spray block was installed on the top of the miner chassis on the scrubber side of the CM approximately 42-inches behind the side scrubber suction inlet 94. The TLD operator side spray block 52 and the TLD scrubber side spray block 53 were temporarily installed approximately 195 inches behind the cutting bit of the miner cutting drum; all of the sprays were directed toward the face of the continuous miner. The TLD scrubber side spray block 53 had three sprays—one oriented N 22° W, one oriented N 00° E, and one oriented N 22° E (where N=North and oriented toward the face, W=West, E=East). The TLD scrubber side spray block 53 had installed misting sprays with about an 80 degree cone angle with a capacity of 0.6 gpm at 80-psi. The TLD operator side spray block 52 consisted of only two installed misting sprays to allow the CM operator to be able to see about 33% of the cutting face and to provide good visibility of the face. The sprays were inclined about 45 degrees from the vertical. This spray system implementing the TLD sprays was tested extensively in the field and compared side-by-side with the conventional spray system. The results indicated that the TLD modified spray system design significantly improved dust control at the MO. HO, and LOXC locations 62%, 38%, and 19%, respectively. The spray orientations, spray capacity, location of the sprays, spray types, and location of the TLD spray blocks listed above are dependent on the type, configuration, and size of the CM as well as the type and configuration of the coal seam and are in no way meant to be limiting.

Figure 1B:
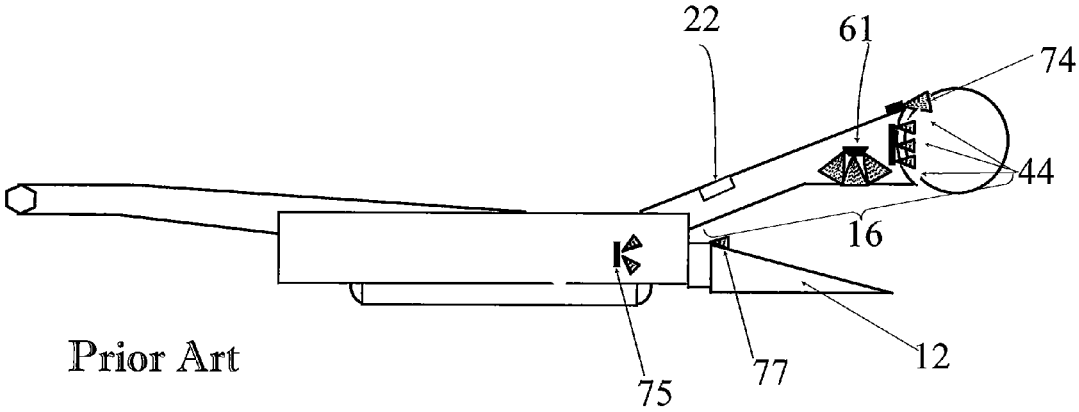

In FIGS. 1A and 1B, a continuous miner chassis is shown, and it can be 42-inches high and a cutting drum that is 11.5 ft wide with a diameter of 42-inch. The length of the CM from the front bits on the miner cutting drum to the back end of continuous miner chassis is about 35 ft. The continuous miner may be extracting an approximately 96-inch thick coal seam with 3-6 inches of immediate roof only. A significant amount of airborne dust can be produced during the production process due to high seam height. In order to minimize the dust rollback from the miner cutting drum, the TLD spray system can include two TLD top spray blocks 51 and TLD operator side 52 and scrubber side 53 spray blocks were installed. Two TLD top spray blocks 51 can be mounted on the top of the continuous miner chassis about 54-inches behind the right and left side scrubber suction inlets 22. TLD operator side 52 and scrubber side 53 spray blocks can be simultaneously located about approximately 200 inches behind the cutting bit of the miner cutting drum on the CM operator side and the return side of the CM chassis, respectively. The sprays in the TLD operator side 52 and scrubber side 53 spray blocks can be directed towards the face of the CM. The TLD scrubber side spray block 53 can have three misting sprays with about approximately an 80 degree cone angle with about approximately a capacity of 0.6 gpm at 80-psi—one oriented N 22° W, one oriented N 00° E, and one oriented N 22° E. These sprays may be operated at about approximately 100 psi pressure. The TLD operator side spray block 52 can include two sprays to allow the CM operator to be able to see about 33% of the cutting face and to provide visibility of the face. The TLD operator side spray block 52 sprays may be inclined about 45 degrees from the vertical and operated at about approximately 100 psi pressure. This spray system was tested extensively in the field and compared side-by-side with a conventional spray system. The results indicated that the modified spray design significantly improved dust control in the face area by 55% at the MO location and 10% at the LOXC locations. The spray orientations, spray capacity, location of the sprays, spray types, and location of the TLD spray blocks listed above are dependent on the type, configuration, and size of the CM as well as the type and configuration of the coal seam and are in no way meant to be limiting.

Figure 2C:
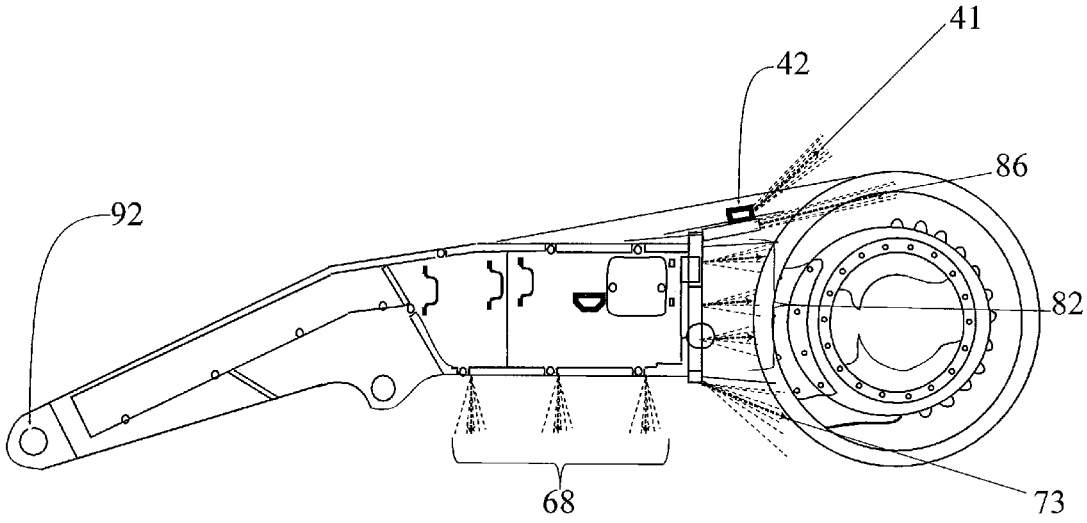

FIG. 2B is a side view of the CM demonstrating the spatial orientation of the side cutter-boom sprays 68 along the cutter boom 90. The under cutter-boom sprays 73 are placed on the underside of the cutter boom 90 behind the cutter drum and are oriented towards the floor of the mining excavation. FIG. 2C is a detailed side view of the cutter boom showing directional orientation of the sprays.

Figure 3A:
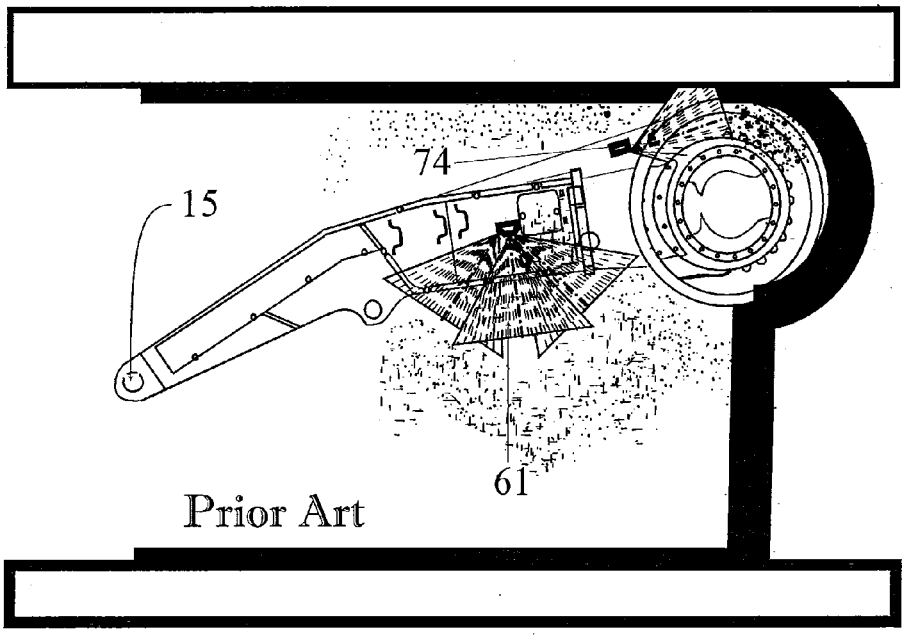
FIG. 3A—(a), (b) A side view of the dust containment of an exemplary conventional spray system around the cutter boom of a continuous miner.
Figure 3A:
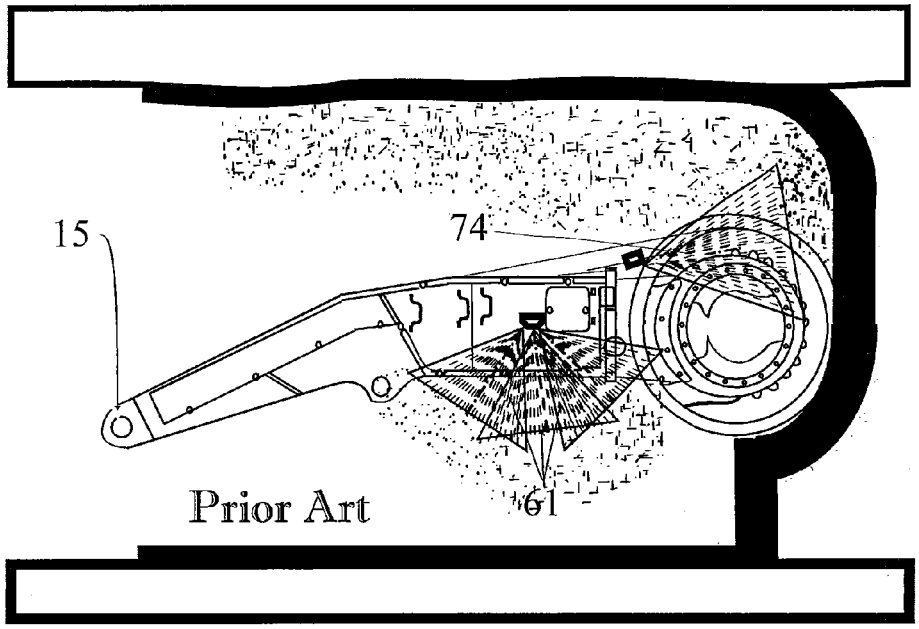
Figure 3B:
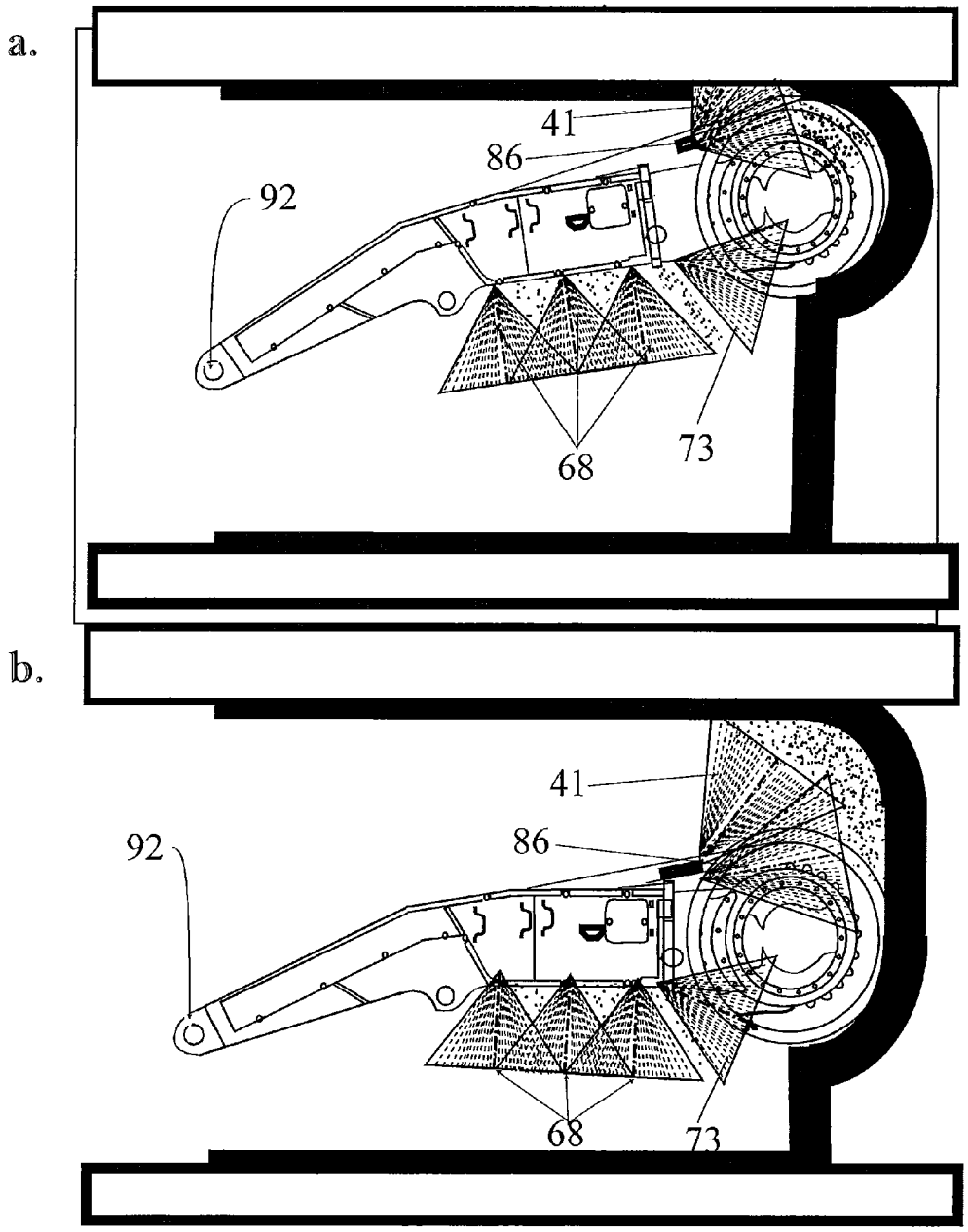

FIG. 3A shows a detailed view of conventional spray coverage and dust rollback from a cutter drum when (a) the CM is cutting the roof of the mining excavation and (b) when the CM is sumping in. In contrast, FIG. 3B illustrates one embodiment of the present invention including spray coverage and minimal dust rollback from the cutter drum of the instant invention when (a) the CM is cutting the roof of the mining excavation and (b) when the CM is sumping-in.

I claim:

1. An apparatus for reducing exposure to respirable dust created by mining equipment comprising:

a cutter drum head spray mounted above a center boom area of a mining equipment and said cutter drum head spray having a cutter drum head spray pattern that is directed forward toward cutting bits of a cutter drum of the mining equipment;

a second line cutter drum head spray mounted above the cutter drum head spray and having a second line cutter drum head spray pattern where the second line cutter drum head spray pattern is angled 10 to 45 degrees above the cutter drum head spray pattern in a vertical plane at a more upward angle with respect to the direction of the cutter drum; and an under cutter-boom spray mounted under a cutter boom of the mining equipment and said under cutter-boom spray having an under cutter-boom spray pattern directed downward with respect to the cutter boom.

2. The apparatus of claim 1, further comprising:

a side cutter-boom spray; and an outer bit-ring spray.

3. The apparatus of claim 2, where the cutter drum head spray, the second line cutter drum head spray, the outer bit-ring spray and the under cutter-boom spray each have spray patterns that are hollow cone spray patterns.

4. The apparatus of claim 3, where the under cutter-boom spray pattern has a spray pressure about 10 to 20 psi lower than the spray pressure of the cutter drum head spray pattern.

5. The apparatus of claim 2, further comprising:

said side cutter-boom spray where a side cutter-boom spray pattern of the side cutter-boom spray is directed into a material load pan positioned aft the cutter drum.

6. The apparatus of claim 2, where the cutter drum head spray and the second line cutter drum head spray and the outer bit-ring spray, having an outer bit-ring spray pattern, where each spray is spatially oriented such that their respective spray pattern paths do not significantly intersect or interfere with other spray pattern paths of surrounding sprays.

7. An apparatus comprising:

a cutter drum head spray mounted above a center boom area of a mining equipment and said cutter drum head spray having a cutter drum head spray pattern that is directed forward toward cutting bits of a cutter drum of the mining equipment;

a second line cutter drum head spray mounted above the cutter drum head spray and having a second line cutter drum head spray pattern where the second line cutter drum head spray pattern is sufficiently angled 10 to 45 degrees above the cutter drum head spray pattern in a vertical plane above the mining equipment directed at a more upward angle with respect to the direction of the cutter drum;

an under cutter-boom spray mounted under a cutter boom of the mining equipment and said under cutter-boom spray having an under cutter-boom spray pattern directed downward with respect to the cutter boom;

a third line side spray mounted on the mining equipment aft with respect to a scrubber inlet and having a third line side spray pattern directed forward toward the cutter drum of the mining equipment and horizontally away from the mining equipment; and a third line top spray mounted on the mining equipment aft with respect to the scrubber inlet and having a third line top spray pattern directed forward toward the cutter drum of the mining equipment and vertically away from the mining equipment, where the cutter drum head spray, the second line cutter drum head spray and the under cutter-boom spray each have spray patterns that are flat spray patterns.

8. An apparatus for reducing exposure to respirable dust created by mining equipment comprising:

a cutter drum head spray mounted above a center boom area of a mining equipment and said cutter drum head spray having a cutter drum head spray pattern that is directed forward toward cutting bits of a cutter drum of the mining equipment;

a second line cutter drum head spray mounted above the cutter drum head spray and having a second line cutter drum head spray pattern that is directed at a more upward angle with respect to the direction of the cutter drum head spray pattern;

an outer bit-ring spray;

an under cutter-boom spray mounted under a cutter boom of the mining equipment and said under cutter-boom spray having an under cutter-boom spray pattern directed downward with respect to the cutter boom;

a third line operator side spray mounted on the mining equipment aft with respect to a scrubber inlet and having a third line operator side spray pattern directed forward toward the cutter drum of the mining equipment and horizontally away from the mining equipment; and a third line top spray mounted on the mining equipment aft with respect to the scrubber inlet and having a third line top spray pattern directed forward toward the cutter drum of the mining equipment and vertically away from the mining equipment.

9. The apparatus of claim 8, where the third line operator side spray and the third line top spray have the third line operator side spray pattern and the third line top spray pattern respectively where each are flat spray patterns.

10. The apparatus of claim 9, where the third line operator side spray and the third line top spray have the third line operator side spray pattern and the third line top spray pattern respectively where each are hollow cone spray patterns.

11. An apparatus for reducing exposure to respirable dust created by mining equipment comprising:

a center head spray block mounted above a center boom area of a mining equipment and left and right side head spray blocks disposed on opposing sides of the center head spray block and each of said center, left and right head spray blocks having a plurality of cutter drum head sprays each having a cutter drum head spray pattern that is directed forward toward cutting bits of a cutter drum of the mining equipment, and each of said center, left and right head spray blocks having a plurality of second line cutter drum head sprays each mounted above the plurality of cutter drum head sprays and each having a second line cutter drum head spray pattern where the second line cutter drum head spray pattern is angled 10 to 45 degrees above the cutter drum head sprays;

an outer bit-ring spray block having a plurality of outer bit-ring sprays each having an outer bit-ring spray pattern angled forward; and a third line of sprays comprising, a third line side spray mounted on the mining equipment aft with respect to a scrubber inlet and having a third line side spray pattern directed forward toward the cutter drum of the mining equipment and horizontally away from the mining equipment.

12. The apparatus of claim 11, where the plurality of cutter drum head sprays, the plurality of second line cutter drum head sprays, and the plurality of outer bit-ring sprays each have spray patterns that are hollow cone spray patterns.

13. The apparatus of claim 11, where the plurality of cutter drum head sprays and the plurality of second line cutter drum head sprays and the plurality of outer bit-ring sprays are spatially oriented such that each respective spray pattern path does not significantly intersect and interfere with another spray pattern path of surrounding sprays.

14. An apparatus comprising:

a center head spray block mounted above a center boom area of a mining equipment and left and right side head spray blocks disposed on opposing sides of the center head spray block and each of said center, left and right head spray blocks having a plurality of cutter drum head sprays each having a cutter drum head spray pattern that is directed forward toward cutting bits of a cutter drum of the mining equipment, and each of said center, left and right head spray blocks having a plurality of second line cutter drum head sprays each mounted above the plurality of cutter drum head sprays and each having a second line cutter drum head spray pattern where the second line cutter drum head sprays are angled 10-45 degrees in a vertical plane above the cutter drum head spray pattern at a more upward angle with respect to the direction of the cutter drum;

an outer bit-ring spray block having a plurality of outer bit-ring sprays each having an outer bit-ring spray pattern angled forward; and a third line of sprays comprising, a third line side spray mounted on the mining equipment aft with respect to a scrubber inlet and having a third line side spray pattern directed forward toward the cutter drum of the mining equipment and horizontally away from the mining equipment, where the third line of sprays further comprise, a third line top spray mounted on the mining machine aft with respect to the scrubber inlet and having a third line top spray pattern directed forward toward the cutter drum of the mining equipment and vertically away from the mining equipment, and where the plurality of cutter drum head sprays, the plurality of second line cutter drum sprays, and the plurality of outer bit-ring sprays each have spray patterns that are flat spray patterns.

15. An apparatus for reducing respirable dust created by mining equipment comprising:

a center head spray block mounted above a center boom area of a mining equipment and left and right side head spray blocks disposed on opposing sides of the center head spray block and each of said center, left and right head spray blocks having a plurality of cutter drum head sprays each having a cutter drum head spray pattern that is directed forward toward cutting bits of a cutter drum of the mining equipment, and each of said center, left and right head spray blocks having a plurality of second line cutter drum head sprays each mounted above the plurality of cutter drum head sprays and each having a second line cutter drum head spray pattern where the second line cutter drum head sprays are angled 10 to 45 degrees above the cutter drum head spray pattern at a more upward angle with respect to the cutter drum;

a throat spray block mounted on the mining equipment forward with respect to a scrubber inlet having a plurality of throat sprays each having a solid cone throat spray pattern angled forward toward the cutter drum of the mining equipment and into a material load pan position aft with respect to the cutter drum of the mining equipment; and a third line of sprays comprising, a third line scrubber side spray mounted on the mining equipment aft with respect to the scrubber inlet and having a third line scrubber side spray pattern directed forward toward the cutter drum of the mining equipment and horizontally away from the mining equipment.

16. An apparatus comprising:

a center head spray block mounted above a center boom area of a mining equipment and left and right side head spray blocks disposed on opposing sides of the center head spray block and each of said center, left and right head spray blocks having a plurality of cutter drum head sprays each having a cutter drum head spray pattern that is directed forward toward cutting bits of a cutter drum of the mining equipment, and each of said center, left and right head spray blocks having a plurality of second line cutter drum head sprays each mounted above the plurality of cutter drum head sprays and each having a second line cutter drum head spray pattern where the second line cutter drum head sprays are angled 10 to 45 degrees above the cutter drum head spray pattern at a more upward angle with respect to the cutter drum;

a throat spray block mounted on the mining equipment forward with respect to a scrubber inlet having a plurality of throat sprays each having a solid cone throat spray pattern angled forward toward the cutter drum of the mining equipment and into a material load pan positioned aft of the cutter drum of the mining equipment; and a third line of sprays comprising, a third line scrubber side spray mounted on the mining equipment aft with respect to a scrubber inlet and having a third line scrubber side spray pattern directed forward toward the cutter drum of the mining equipment and horizontally away from the mining equipment, where the third line of sprays further comprise, a third line top spray mounted on the mining machine aft with respect to the scrubber inlet and having a third line top spray pattern directed forward toward the cutter drum of the mining equipment and vertically away from the mining equipment, and where a spray pressure of the plurality of throat sprays are adjusted to adequately wet any broken material in the material load pan positioned aft of the cutter drum.

* * * * *